US006932641B1

(12) United States Patent
Liao

(10) Patent No.: US 6,932,641 B1
(45) Date of Patent: Aug. 23, 2005

(54) PLUG STRUCTURE

(76) Inventor: Sheng Hsin Liao, No. 10, Alley 38, Lane 229, San Chun St., Shulin City, Taipei Hsien (TW)

( * ) Notice: Subject to any disclaimer, the term of this patent is extended or adjusted under 35 U.S.C. 154(b) by 0 days.

(21) Appl. No.: 10/781,770

(22) Filed: Feb. 20, 2004

(51) Int. Cl.[7] ..... H01R 13/58
(52) U.S. Cl. ..... 439/460; 439/418
(58) Field of Search ..... 439/460, 418, 439/676, 445, 447

(56) References Cited

U.S. PATENT DOCUMENTS 4,431,246 A * 2/1984 Vaden ..... 439/404
4,516,822 A * 5/1985 Wolfel ..... 439/468
4,713,023 A * 12/1987 Bixler et al. ..... 439/393
4,950,176 A * 8/1990 Cocco et al. ..... 439/344
5,505,638 A * 4/1996 Su et al. ..... 439/676
5,888,100 A * 3/1999 Bofill et al. ..... 439/676
5,899,770 A * 5/1999 Ezawa ..... 439/418
5,967,801 A * 10/1999 Martin et al. ..... 439/76.1
6,116,943 A * 9/2000 Ferrill et al. ..... 439/418
6,250,949 B1 * 6/2001 Lin ..... 439/418
6,375,491 B1 * 4/2002 Durand et al. ..... 439/418
6,388,191 B1 * 5/2002 Maegawa ..... 174/50
6,406,325 B1 * 6/2002 Chen ..... 439/418
6,663,415 B1 * 12/2003 Wu ..... 439/460
6,682,363 B1 * 1/2004 Chang ..... 439/418
6,706,970 B2 * 3/2004 Laub et al. ..... 174/135
6,764,333 B2 * 7/2004 Pocrass ..... 439/418

* cited by examiner

*Primary Examiner*—Ross Gushi
*Assistant Examiner*—Larisa Tsukerman
(74) *Attorney, Agent, or Firm*—Rosenberg, Klein & Lee

(57) ABSTRACT

A plug structure has a base defining a plurality of slots formed therein, a plurality of contacts arranged in the slots, a connection member defining a plurality of slits formed in a front thereof, and a plurality of conduction cords receiving in the slots. The connection member has an orientation member disposed thereon to press the conduction cords for electrically connecting the conduction cords to be more securely fastened.

15 Claims, 10 Drawing Sheets

PLUG STRUCTURE

BACKGROUND OF THE INVENTION

1. Field of the Invention

The present invention relates to a plug structure, and particularly relates to a plug structure adopted for electrically connecting a plurality of conduction cords to be more secured and fastened.

2. Background of the Invention

Referring to FIG. 1, a conventional plug is adopted for electrically connecting a plurality of conduction cords, and is particularly adopted for connecting between a computer or telephone cables. The conventional plug includes a base 10*a*, and a device 11*a* disposed on an exterior side thereof for engagement and orientation. The base 10*a* includes a plurality of contacts 12*a*, each contacts 12*a* can shift longitudinally with a short distance, each contacts 12*a* has a connection member 13*a* arranged on a top therein, the connection member 13*a* has a plurality of slots 14*a* respectively relating to the contacts 12*a*, and the contacts 12*a* accordingly insert into the connection member 13*a* via the slots 14*a*. The connection member 13*a* has a plurality of guiding slots (not shown) formed therein.

When the conduction cords 20*a* connect to the plug, the conduction cords 20*a* are inserted into the base 10*a* from a rear thereof, the cords 20*a* penetrate through the connection member 13*a* via the guiding slots and the slots 14*a*, and the contacts 12*a* stab the cords respectively to connect electrically inner conductive materials in the cores 20.

However, the conventional plug connects the cords 20*a* without precise orientation and security, and the cords 20*a* slip off the connection member 13*a* easily to disconnect electrically the contacts 12*a*.

Hence, an improvement over the prior art is required to overcome the disadvantages thereof.

SUMMARY OF INVENTION

The primary object of the invention is therefore to specify a plug structure with an orientation member to press and orientate cords; the cords thus connect the plug structure securely without the cords slipping off the plug structure to disconnect electrically.

According to the invention, these objects are achieved by a plug structure including a base defining a receiving cavity formed therein and a plurality of slots formed in a front thereof to communicate with the receiving cavity, a plurality of contacts arranged in the slots, a connection member defining a plurality of slits formed in a front thereof and a plurality of conduction cords receiving into the slits. The base includes a member disposed on an exterior side thereof, the connection member includes an orientation member disposed thereon and the conduction cords are retained against the orientation member to for orientation. The connection member is disposed in the receiving cavity, and the contacts are pressed in the slots to pierce into the conduction cords for electrical connection.

To provide a further understanding of the invention, the following detailed description illustrates embodiments and examples of the invention. Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE EMBODIMENTS

Figure 1:
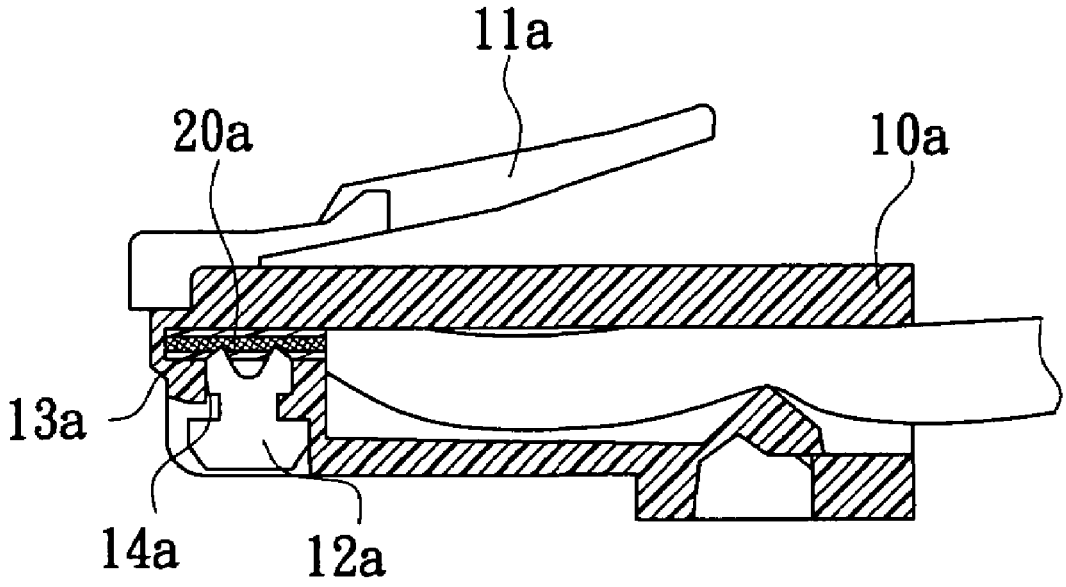
FIG. 1 PRIOR ART
FIG. 1 is a cross-sectional profile of a conventional plug structure.
Figure 2:
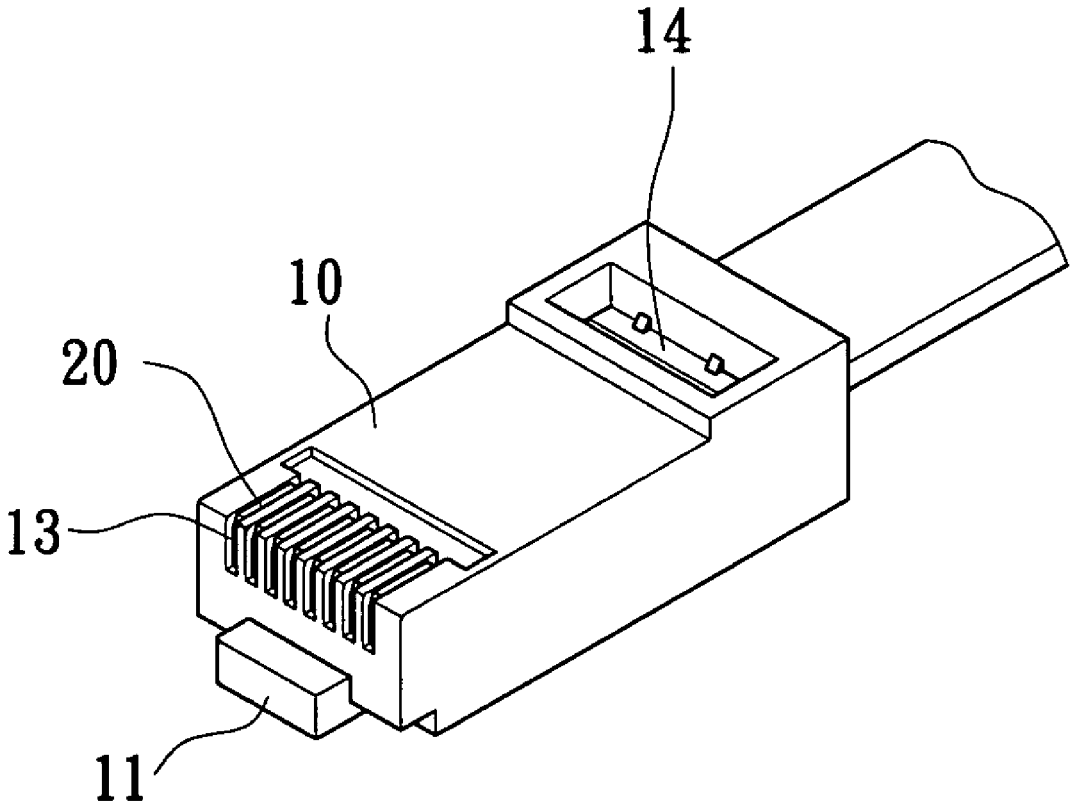
FIG. 2 is a perspective view according to a first embodiment of the present invention.

With respect to FIGS. 2 to 5, the present invention provides a plug structure including a base 10, a plurality of contacts 20, a connection member 30 and a plurality of conduction cords 40. The base 10 is made of insulating materials, such as plastic, and the base 10 includes a member 11 disposed on an exterior side thereof. The base 10 defines a receiving cavity 12 formed therein, an opening formed in a rear thereof to communicate with the receiving cavity 12, and a plurality of slots 13 formed in a front thereof to communicate with the receiving cavity 12. The slots 13 are formed with predetermined equal distances spaced therebetween. The base 10 has a buckling portion 14 disposed on a side in the receiving cavity 12 of the base 10.

The contacts 20 is made of conductive materials, such as copper. The contacts 20 are respectively arranged in the slots 13. The contacts 20 respectively have needle portions 21 arranged at ends thereof, so as to pierce and electrically connect the conduction cords 40, respectively.

Figure 3:
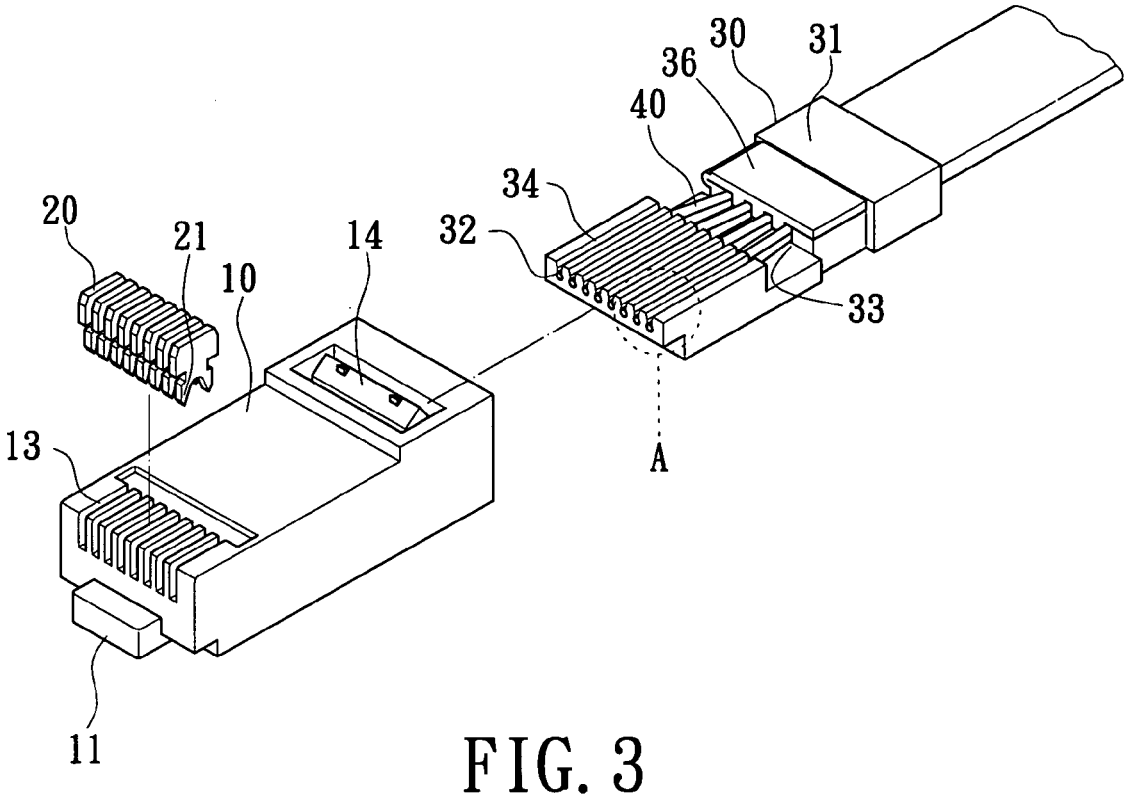
FIG. 3 is a decomposition view of the first embodiment while a plurality of conduction cords connecting the connection member.
Figure 3A:
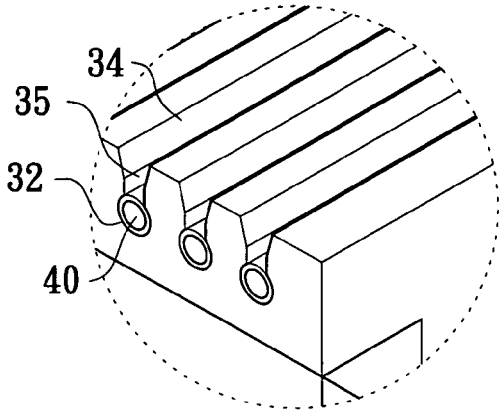
FIG. 3A is an enlarged view according to FIG. 3.
Figure 4:
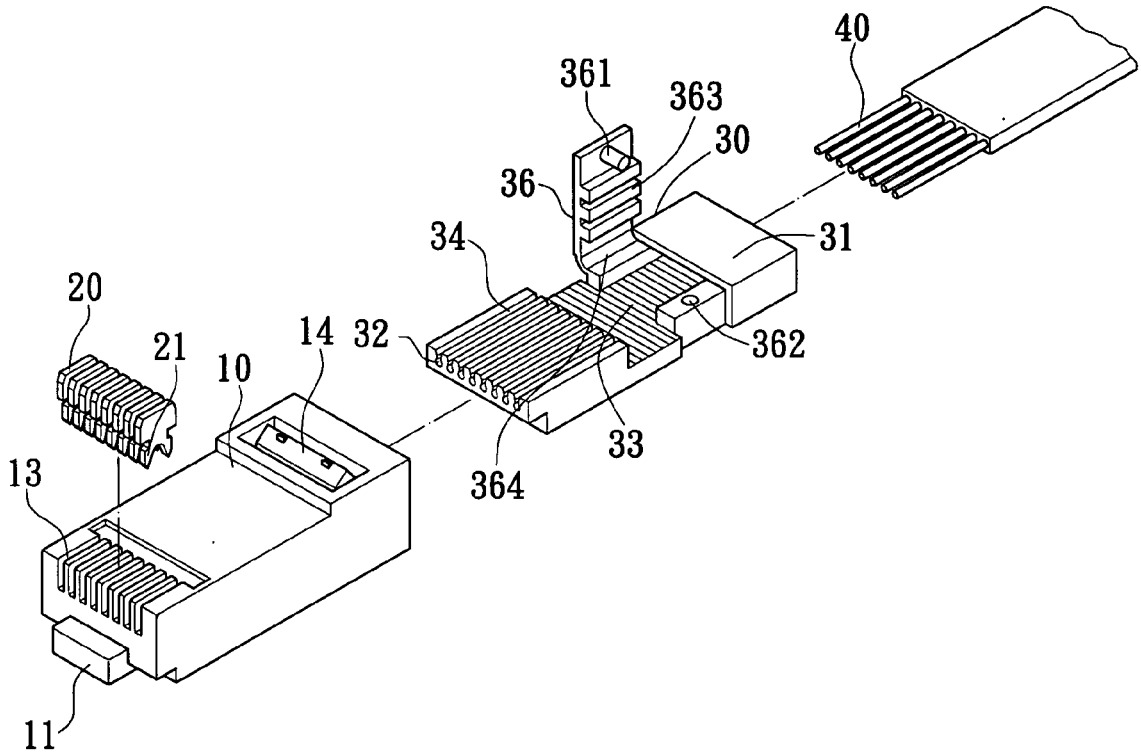
FIG. 4 is a decomposition view of the first embodiment when the conduction cords are disconnected from the connection member.
Figure 5:
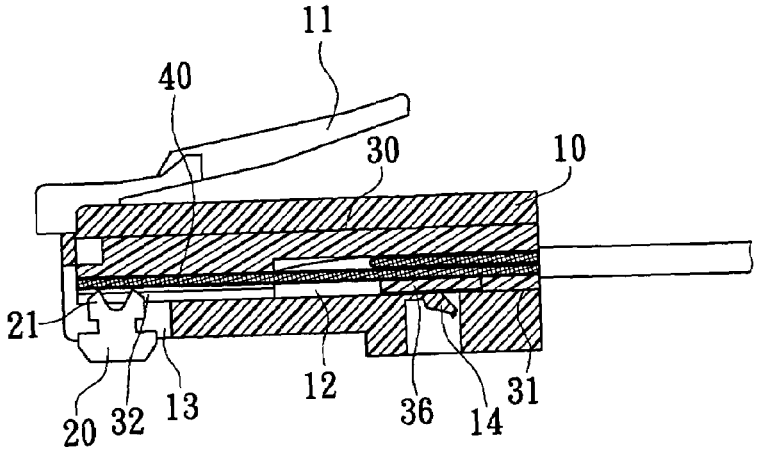
FIG. 5 is a first longitudinal profile according to the first embodiment.

The connection member 30 is made of insulating materials, such as plastics. The connection member 30 includes a hollow shell 31 disposed at a rear thereof; the hollow shell 31 has two outlets relatively formed in a rear and a front thereof for the conduction cords 40 to penetrate therein. The connection member 30 defines a plurality of slits 32 formed in a front thereof, and a recessed cavity 33 is formed thereon adjacent to the hollow shell 31 and the slits 32. The slits 32 are formed on the connection member 30 with predetermined equal distances spaced therebetween. The connection member 30 includes a sidewall defining an aperture 35 adjacent to and communicating with the slits, and the conduction cords 40 are arranged in the slits 32 via the aperture (see FIG. 3A). The sidewall has two guiding inclined surfaces 34 formed on two opposing sides adjacent to the aperture 35, and the aperture 35 is split and narrower than each slit 32. Illustrated in FIG. 12, the slits 32 and the aperture 35 can be designed with different types.

Figure 8:
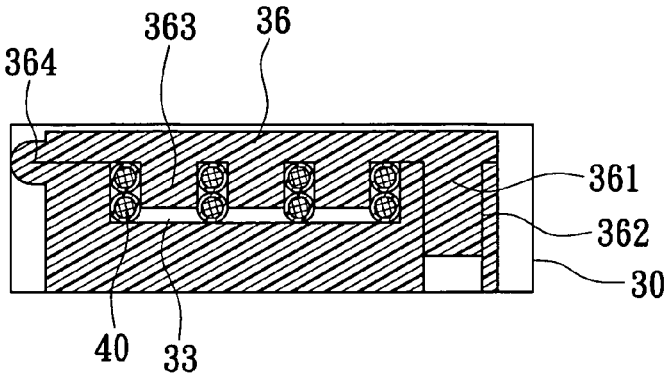
FIG. 8 is a lateral profile of the connection member and the conduction cords according to the first embodiment.

The connection member 30 includes an orientation member 36 disposed above the recessed cavity 33, the orientation member 36 is adjacent to the hollow shell 31 and the slits 32, and the conduction cords 40 penetrate the hollow shell 31 into the slits 32. The orientation member 36 includes a resilient juncture portion 364 made integrally in one piece from the connection member 30 and is adjacent to a side of the recessed cavity 33. The orientation member 36 is thus capable of being lifted or covered via the resilient juncture portion 364. The orientation member 36 is flat and plate-like, and includes an orientation pillar 361 protruding therefrom and opposite the resilient juncture portion 364. The connection member 30 has a secured hole 362 formed thereon corresponding to the orientation pillar 361 and communicating with the recessed cavity 33. The orientation pillar 361 inserts into the secured hole 362 while the orientation member 36 covers the same. The orientation pillar 361 and the secured hole 362 combine into a lock unit and the orientation member 36 is secured by a lock unit, while the orientation member 36 covers the same. The orientation member 36 has a plurality of partitions 363 arranged on an interior surface thereof with predetermined equal distances spaced therebetween to separate the conduction cords 40, respectively. Each partition 363 is elongated in a strip or cylindrical shape. Each conduction cord 40 is of a flat wire type, or a round wire type. In this embodiment, the conduction cords 40 are of a flat wire type, the conduction cords 40 penetrate through the hollow shell 31 from the rear thereof into the connection member 30 via the recessed cavity 33. According to the embodiment, the conduction cords 40 are pressed into the slits 32 via the aperture 35, the orientation member 36 covers the recessed cavity 33, the orientation pillar 361 is accommodated in the secured hole 362 for the orientation member 36 to press and orient the conduction cords 40 (see FIG. 8). The partitions 363 separate the conduction cords 40 respectively for the cords 40 to connect with the connection member 30 in advance (shown in FIG. 3).

Figure 6:
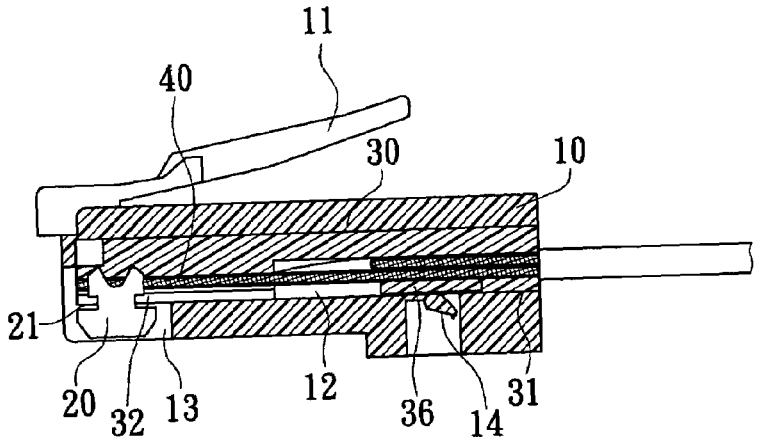
FIG. 6 is a second longitudinal profile according to the first embodiment.

The connection member 30 inserts into the receiving cavity 12 in the base 10 from the rear thereof, the connection member 30 carries the conduction cords 40 to penetrate the front of the base 10 and engage therein (see FIG. 5), and the connection member 30 and the base 10 combine into an integral piece. The contacts 20 are pressed into the slots 13, the needle portions 21 pierce the conduction cords 40, respectively, to connect electrically inner conductive materials therein (see FIG. 6).

Figure 7:
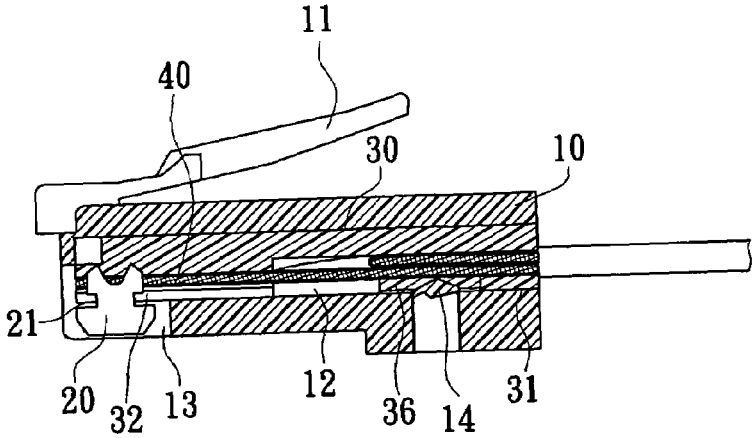
FIG. 7 is a third longitudinal profile according to the first embodiment.

For the connection member 30 to be firmly oriented in the receiving cavity 12, the buckling portion 14 is pushed inwardly and is retained against the orientation member 36 (see FIG. 7), so as to connect firmly the connection member 30 in the receiving cavity 12 of the base 10. The orientation member 36 can furthermore press to orientate the cords 40.

The present invention pre-connects the cords 40 to the connection member 30 outside the base 40, the connection member 30 define the aperture 35 adjacent to and communicating with the slits 32, the conduction cords 40 are arranged into the slits 32 via the aperture 35, and the connection member 30 carries the conduction cords 40 into the base 10 to connect electrically the contacts 20. Furthermore, the aperture 35 is narrower than each slit 32 and an exterior diameter of each conduction cord 40, so as to prevent the conduction cords 40 from slipping out of the slits 32.

Figure 9:
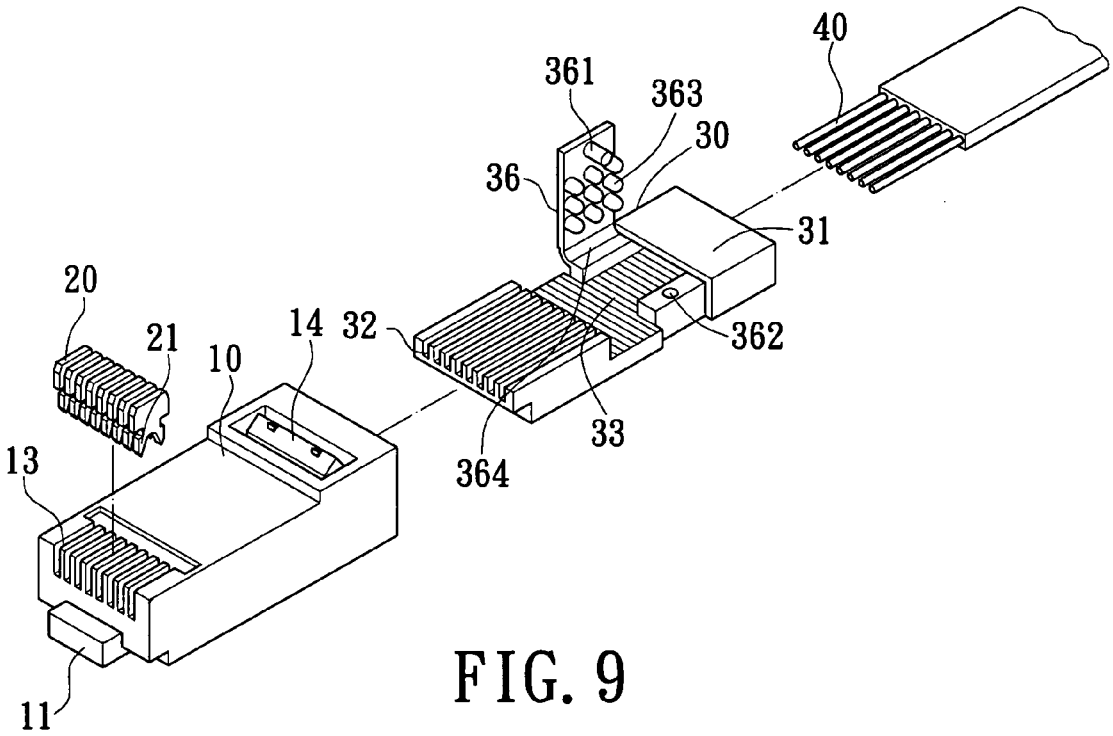
FIG. 9 is a perspective view according to a second embodiment of the present invention.

Referring to FIG. 9, the slits 32 are rectangular, and the partitions 363 can be cylindrical in shape.

Figure 10:
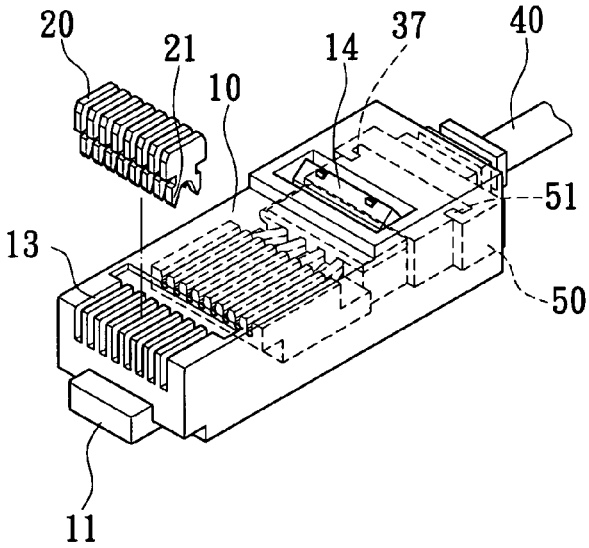
FIG. 10 is a perspective view according to a third embodiment of the present invention.
Figure 11:
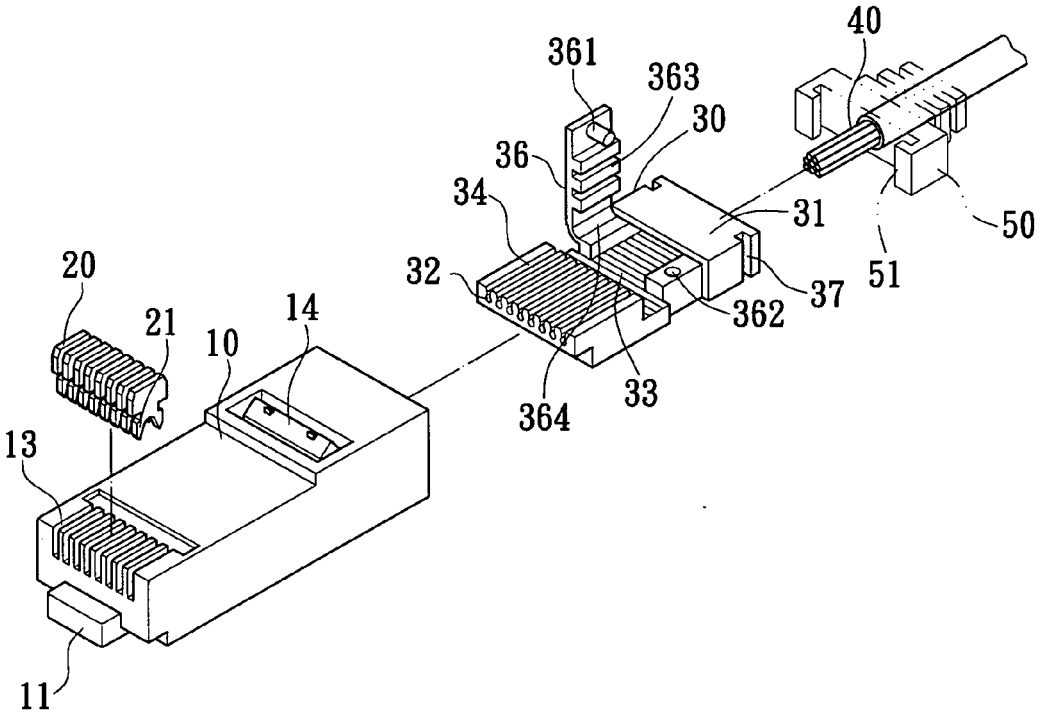
FIG. 11 is a decomposition view according to the third embodiment of the present invention.

FIGS. 10 and 11 shows the conduction cords 40 as being of a round type. The conduction cords 40 are made integrally in one piece from a socket 50 during a mold process. The socket 50 includes an engaging portion 51 arranged on each lateral side thereof, the engaging portion 51 engages and connects with an engaging slot 37 correspondingly formed on the connection member 30, and the conduction cords 40 connect the rear of the connection member 30 via the socket 50.

Figure 12:
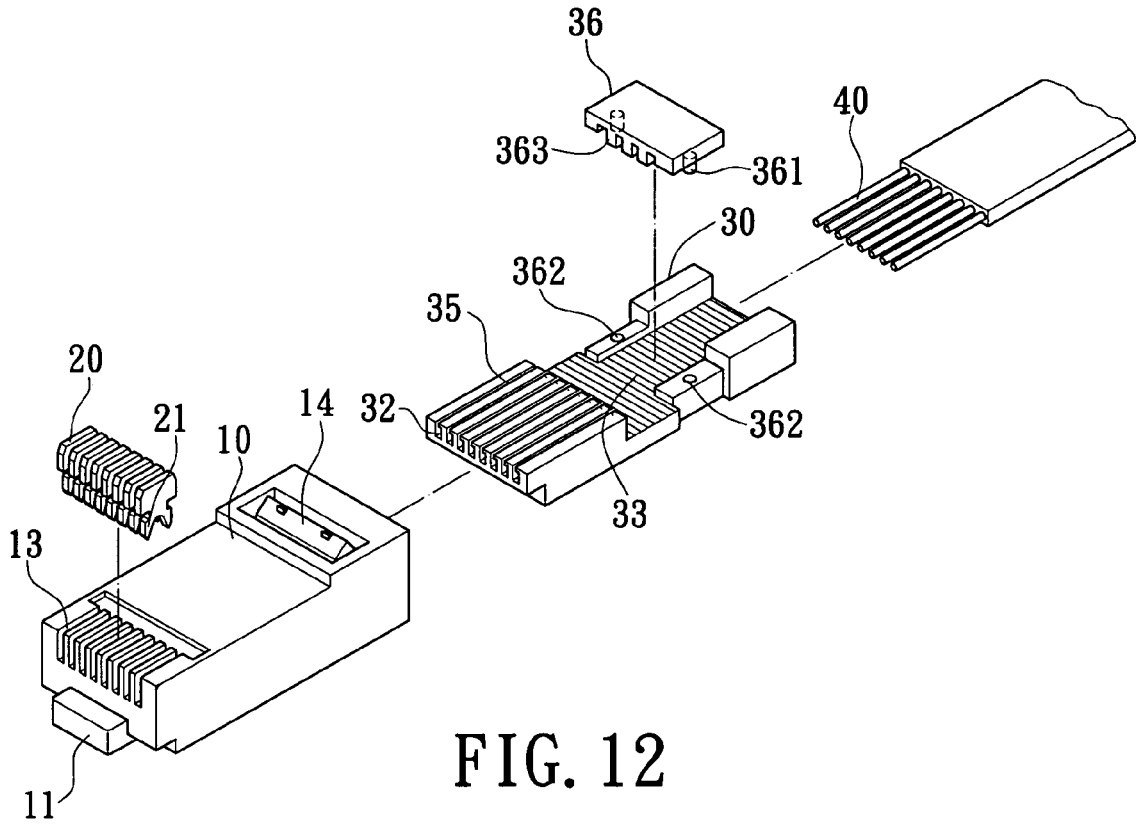
FIG. 12 is a decomposition view according to a fourth embodiment of the present invention.

Referring to FIG. 12, the orientation member 36 and the connection member 30 are detachable, the orientation member 36 can be lifted or covered thereby, and the orientation member 30 is secured by a lock unit while the orientation member 36 is covered. According to the embodiment, the orientation member 36 includes an orientation pillar 361 disposed on each lateral side of the bottom thereof; the connection member 30 has a secured hole 362 formed thereon and communicating with the recessed cavity 33. The orientation pillar 361 and the secured hole 362 combine into the lock unit. In addition, the hollow shell 31 can be omitted.

Figure 13:
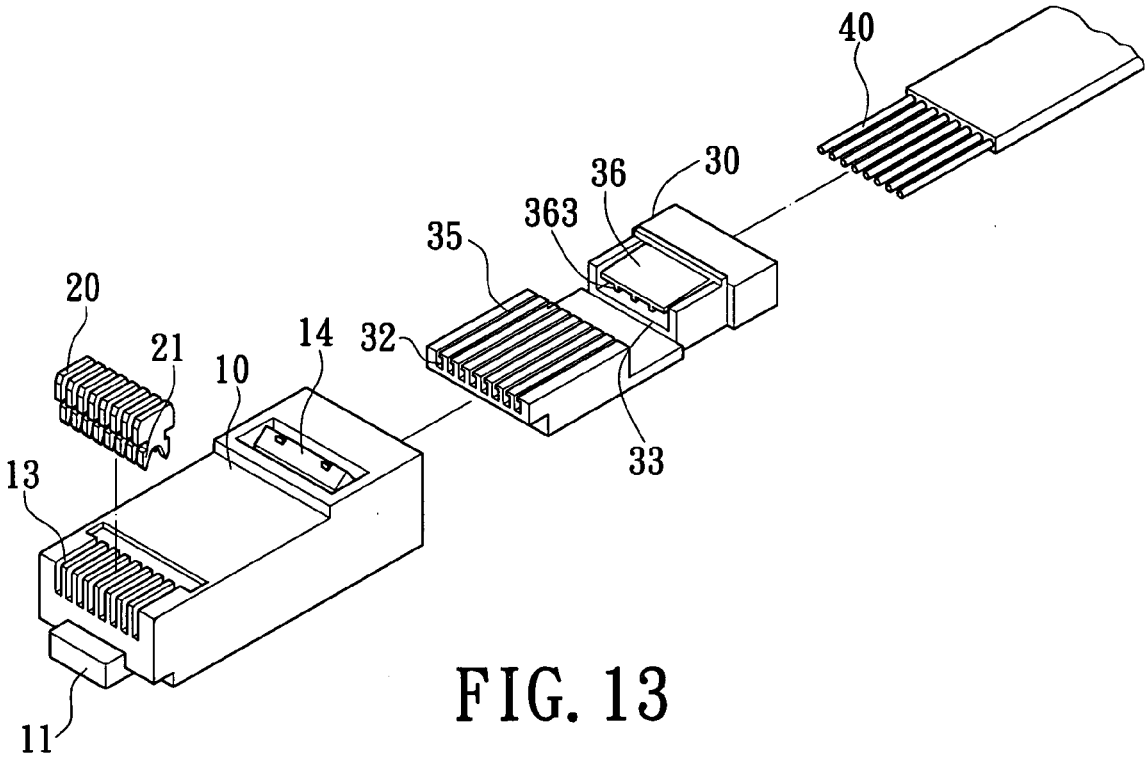
FIG. 13 is a decomposition view according to a fifth embodiment of the present invention.
Figure 14:
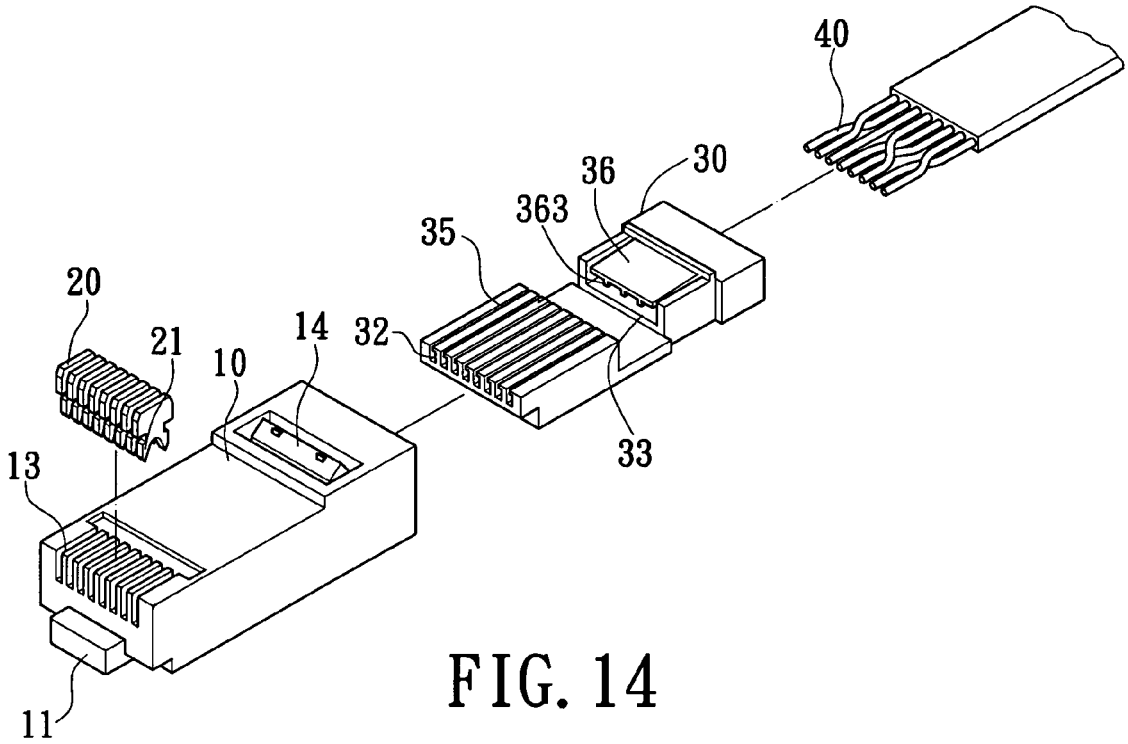
FIG. 14 is a decomposition view according to a sixth embodiment of the present invention.

With respect to FIG. 13, the orientation member 36 is provided with a resilient function, the orientation member 36 includes an end connecting to the connection member 30 and an opposite end being free, the orientation member 36 is resilient to oscillate upwards and downwards, and thus the orientation member 36 resiliently presses the conduction cords 40. In another embodiment, illustrated in FIG. 14, the conduction cords 40 wind around each other.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. A plug structure comprising:

a base having a receiving cavity formed therein, a plurality of slots formed in a front thereof to communicate with the receiving cavity, and a buckling portion disposed on a side in the receiving cavity of the base;

a plurality of contacts arranged in the slots;

a connection member defining a plurality of slits formed in a front thereof, and including an orientation member disposed thereon; and a plurality of conduction cords received in the respective slits and retained against the orientation member;

wherein the connection member is disposed in the receiving cavity, the contacts are pressed in the slots to pierce into the conduction cords to make an electrical connection, and the buckling portion is capable of being pressed on the orientation member of the connection member.

2. The plug structure as claimed in claim 1, wherein each of the contacts is provided with at least two ends and each contact further comprises a needle portion disposed at said at least two ends thereof so as to pierce and electrically connect each of the conduction cords respectively.

3. The plug structure as claimed in claim 1, wherein the connection member defines an aperture formed at a sidewall thereof and communicating with the slits, with the conduction cords disposed in the slits via the aperture.

4. The plug structure as claimed in claim 3, wherein the connection member comprises a pair of guiding inclined surfaces with each guiding inclined surface formed respectively on a pair of opposing sides adjacent to the aperture, and the aperture is split and narrower than the slit.

5. The plug structure as claimed in claim 1, wherein the connection member comprises a hollow shell disposed at a rear thereof, the orientation member is disposed between the hollow shell and the slit, and the conduction cords are received into the slits via the hollow shell.

6. The plug structure as claimed in claim 5, wherein the connection member has comprises a recessed cavity formed between the hollow shell and the slits for communication, with the orientation member is disposed above the recessed cavity and the hollow shell of the connection member further comprising a pair of outlets formed respectively on a rear and a front thereof.

7. The plug structure as claimed in claim 1, wherein the orientation member comprises a resilient juncture portion formed integrally as one piece from the connection member, with the orientation member being lifted or covered thereby, and the orientation member is secured by a lock unit when the orientation member is covered.

8. The plug structure as claimed in claim 7, wherein the lock unit comprises an orientation pillar connecting the orientation member and a secured hole formed in the connection member, wherein said orientation pillar inserts into the secured hole when said orientation member is covered.

9. The plug structure as claimed in claim 1, wherein the orientation member and the connection member are detachable, with the orientation member capable of being lifted and covered thereby, with the orientation member secured by a lock unit when said orientation member is covered.

10. The plug structure as claimed in claim 9, wherein the lock unit comprises an orientation pillar disposed on each lateral side of the orientation member, and further comprises a secured hole formed in the connection member to communicate with the recessed cavity and corresponding orientation pillar so that the orientation pillar inserts into the secured hole when the orientation member is covered.

11. The plug structure as claimed in claim 1, wherein the orientation member comprises a plurality of partitions disposed on an interior surface thereof so as to separate the conduction cords, respectively.

12. The plug structure as claimed in claim 11, wherein each of said plurality of partitions is an elongated strip or cylinder.

13. The plug structure as claimed in claim 1, wherein each of the conduction cords is a flat wire.

14. The plug structure as claimed in claim 1, wherein each of the conduction cords is a wire with a circular cross-section and connects to a socket that comprises a pair of engaging portions, each respectively disposed on a lateral side thereof so that each of said pair of engaging portions engages and connects with an engaging slot correspondingly formed on the connection member.

15. The plug structure as claimed in claim 1, wherein the orientation member comprises first end connected to the connection member, and an opposite second end being free of connections, wherein the orientation member resiliently oscillates upwards and downwards, and the orientation member thus resiliently presses against the conduction cords.

* * * * *